United States Patent [19]

DePriest

[11] Patent Number: 4,973,273

[45] Date of Patent: Nov. 27, 1990

[54] DUAL-BEAM RECEPTACLE SOCKET CONTACT

[75] Inventor: James F. DePriest, New Albany, Ind.

[73] Assignee: Robinson Nugent, Inc., New Albany, Ind.

[21] Appl. No.: 410,870

[22] Filed: Sep. 22, 1989

[51] Int. Cl.[5] ..... H01R 13/11

[52] U.S. Cl. ..... 439/856

[58] Field of Search ..... 439/856, 857, 861, 862

[56] References Cited

U.S. PATENT DOCUMENTS 3,823,392 7/1974 Pfeifer ..... 439/856

4,607,907 8/1986 Bogursky ..... 439/856

*Primary Examiner*—Joseph H. McGlynn

*Attorney, Agent, or Firm*—Barnes & Thornburg

[57] ABSTRACT

A dual-beam receptacle socket contact is provided for conductively engaging a pin contact to couple the pin contact to an electrical circuit. The two pin-engaging beams of the socket contact are oriented to lie in mutually orthogonal planes. The beams are configured and arranged to maintain electrical contact with a pin contact inserted therein when subjected to shock or vibration. A flat pattern is provided for producing a plurality of socket contacts that are arranged in nested relation so that the center-to-center spacing of the socket contacts match the center-to-center spacing of the contact-receiving openings formed in an electrical contact housing. Preloading tabs are provided in a second embodiment of the invention.

34 Claims, 2 Drawing Sheets

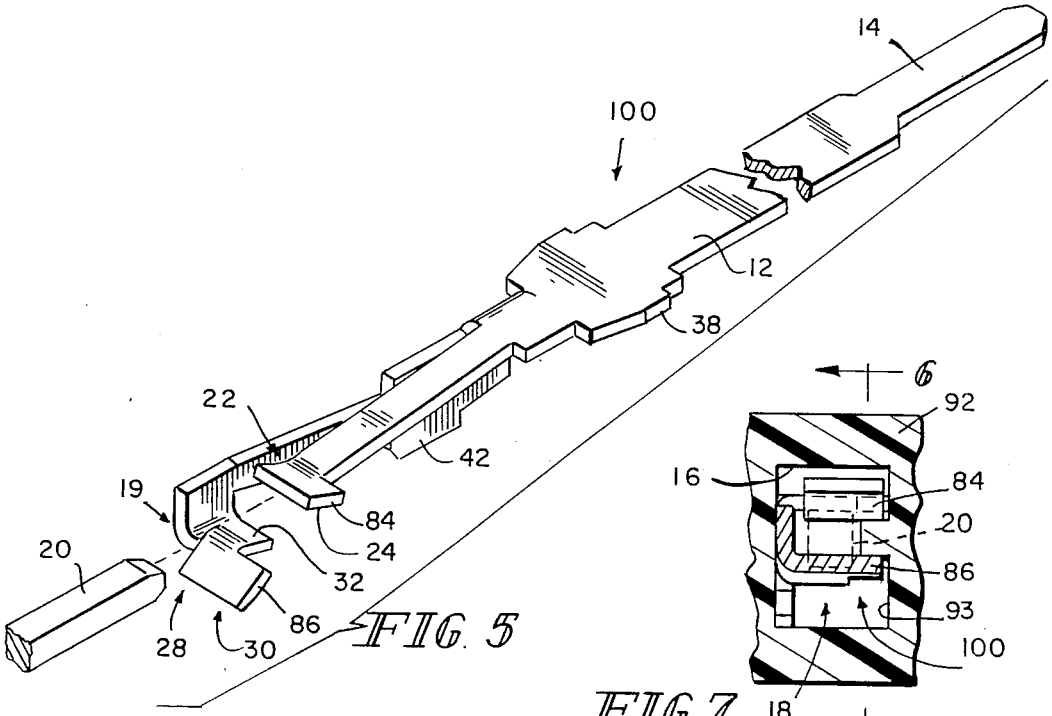
FIG. 5
FIG. 7
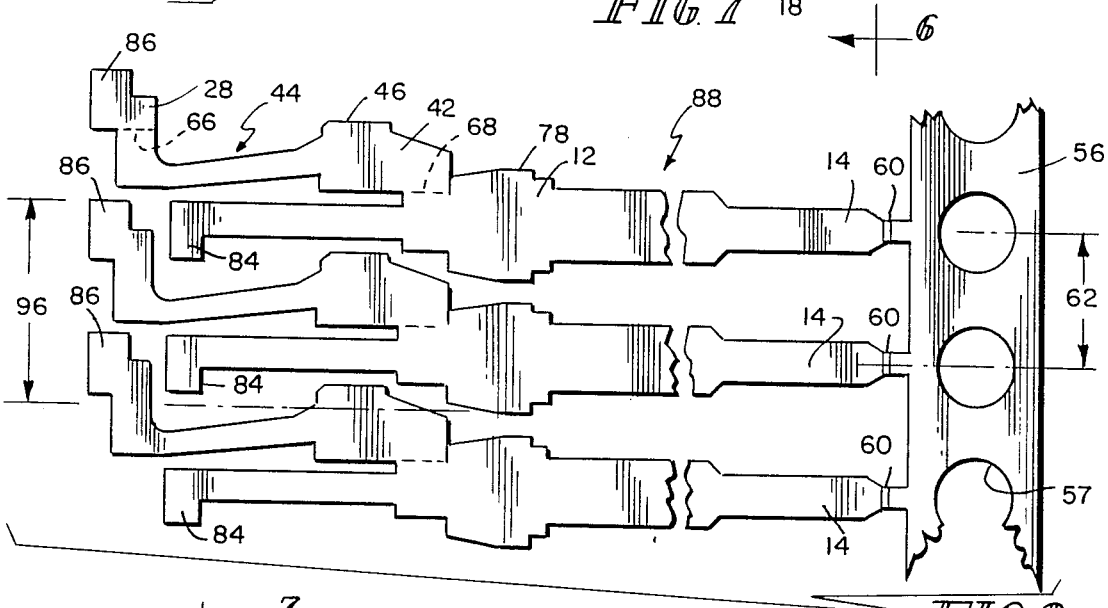
FIG. 8
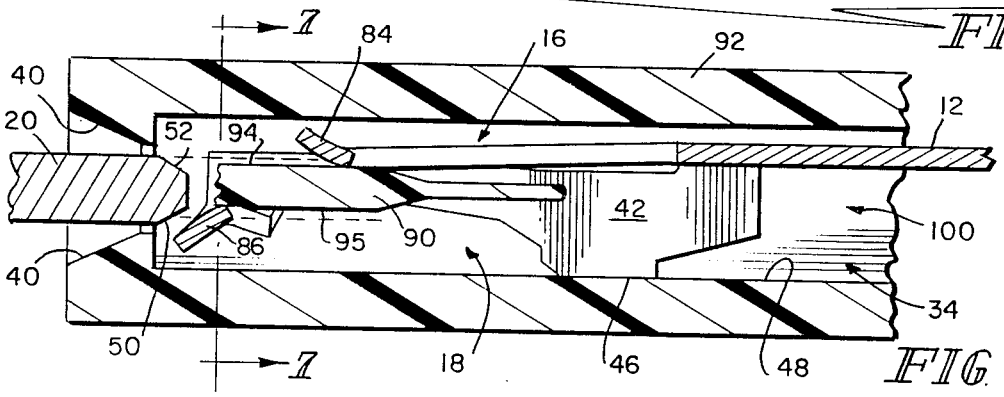
FIG. 6

DUAL-BEAM RECEPTACLE SOCKET CONTACT

BACKGROUND AND SUMMARY OF THE INVENTION

This invention relates to electronic connectors and, in particular, to a dual-beam receptacle socket contact for conductively engaging a pin contact to couple the pin contact to an electrical circuit. More particularly, this invention relates to a socket contact having its pin-engaging beams oriented to lie in orthogonal planes and a flat pattern for producing a plurality of such socket contacts.

Receptacle-type socket contacts are typically produced by stamp-forming suitable sheet material to provide a carrier strip and a plurality of flat socket contacts connected to the carrier strip at uniformly spaced-apart junction points along an edge of the carrier strip. A series of dies can be used to accomplish the stamp-forming step. A rotatable sprocket wheel or the like can engage perforations formed in the carrier strip and rotate to move the sheet material appended to the strip through the series of dies to produce a flat pattern. Once stamped, the flat socket contacts included in the flat pattern are bent or otherwise formed to assume a final shape configured to provide receptacles for receiving pin contacts.

Once the socket contacts are fully formed, they are ready for insertion into contact-receiving openings formed in an electrical connector housing. It is desirable to "gang-insert" all of the fully formed socket contacts provided by a flat pattern into the contact-receiving openings in an electrical connector housing simultaneously to produce an electrical connector in the most efficient manner possible. In certain applications, it is best to "seed" all of the socket contacts in the connector housing openings first and then sever the carrier strip at junctions between the carrier strip and the solder tail of each socket contact to leave the socket contacts in their mounted positions in the connector housing. In other applications, it is desirable to grip each of the socket contact solder tails by means of a separate clamping fixture and then sever the carrier strip so that the clamping fixture can be used instead of the carrier strip to gang-insert the socket contacts into the connector housing openings.

A conventional electrical connector housing is formed to include an array of uniformly spaced-apart contact-receiving openings. In such a connector housing, the "center-to-center" spacing of adjacent pairs of contact-receiving openings is constant. It is best to configure the flat pattern so that the center-to-center spacing between adjacent socket contacts on the carrier strip or the like is equivalent to the center-to-center spacing of the contact-receiving openings to ensure that the socket contacts can be gang-inserted into the openings formed in the connector housing. Such a configuration will result in a flat pattern that is compatible with a particular style of connector housing.

Problems arise in seeding conventional socket contacts into connector housing openings if the center-to-center spacing of the conventional socket contacts is greater than the center-to-center spacing of the contact-receiving openings in the connector housing. For example, a conventional flat pattern having a plurality of socket contacts arranged on 0.170 inch center-to-center spacing cannot be gang-inserted into a connector housing having openings arranged on 0.100 inch center-to-center spacing because of the spacing mismatch between the "socket" centers and the "opening" centers. In such a circumstance, it is generally necessary to seed each socket contact individually in a selected connector housing opening. Even though use of this procedure might not result in a lot of wasted, unused, flat pattern sheet material, it is nevertheless inefficient and uneconomical.

Alternatively, it is known to configure a flat pattern to have a center spacing between sockets that is twice the dimension of the center spacing between connector housing openings so that all odd and even-numbered connector housing openings can be seeded with a socket contact following the completion of two successive gang-insertion steps. In a first step, a first flat pattern is used to gang-insert all of its socket contacts into odd-numbered openings skipping the even-numbered openings. In a second step, a second flat pattern is used to gang-insert all of its socket contacts into the unfilled even-numbered openings. For example, a first conventional flat pattern having a plurality of socket contacts arranged on 0.200 inch center-to-center spacing can be used to seed the odd-numbered openings of a connector housing having openings arranged on 0.100 inch center-to-center spacing and a second conventional flat pattern of identical construction next can be used to seed the unfilled even-number openings of the same housing. In this case, a significant amount of valuable flat pattern sheet material is unused in the stamp-forming step and thereby wasted because of the need to spread the socket contacts far enough apart on the flat pattern to double the center-to-center spacing of the housing openings. Further, although automatic handling equipment can be employed to seed the connector housing automatically using two flat patterns in succession, the seeding process is slowed considerably because two passes are necessary to fill all of the odd-numbered and even-numbered openings.

Turning to another matter, it will be appreciated that socket contacts are susceptible to disfunction problems in use caused by shock or vibration. For example, the electrical connection between a socket contact and a pin contact inserted therein can fail intermittently. A dual-beam receptacle socket contact includes a pair of beams configured to trap a pin contact therebetween to establish an electrical connection between the pin contact and the socket contact. In use, these beams are often exposed to shock and vibration sufficient to cause each beam to bounce or vibrate at a characteristic frequency. The electrical connection between the pin and socket contacts can be broken intermittently if the contacts are exposed to shock or vibration of a type which causes each beam to vibrate at the same frequency. Development of a dual-beam receptacle socket which is configured to minimize the chance that the normal frequency of each beam is the same would avoid shortcomings of conventional dual beam receptacle sockets known to experience "contact bounce" or "electrical intermittency" when subjected to shock or vibration.

One object of the present invention is to provide a socket contact that is better able to maintain electrical contact with a pin contact inserted therein when subjected to shock or vibration.

Another object of the present invention is to provide a socket contact that is produced easily by stamp-forming sheet material without wasting valuable sheet material during manufacture of the flat pattern of the socket contact.

Yet another object of the present invention is to provide a socket contact having a pair of beams which are shaped and arranged to permit nesting of a series of socket contacts in a flat pattern prior to separation of the socket contacts from a carrier strip so as to conserve the valuable sheet material from which the flat pattern is made.

Still another object of the present invention is to mount socket contacts in an electrical connector housing by developing a flat pattern having a series of socket contacts arranged on a center-to-center spacing that is equivalent to the center-to-center spacing of the socket contact-receiving apertures formed in an electrical connector housing.

According to the present invention, an electrical socket contact is provided for conductively engaging a pin contact. The socket contact includes a body portion having a tail for connection to an electrical circuit and a pair of beams. A first of the beams has a proximal end cantilevered to the body portion and a distal end configured to provide a first contact mating surface. A second beam is arranged to lie alongside the first beam. The second beam includes a blade having a second contact mating surface and a support arm having a proximal portion cantilevered to the body portion and a distal portion. The blade is coupled to the support arm at one side of the distal portion to lie at an angle to the distal portion so as to support the second contact mating surface in opposing relation to the first contact mating surface to define a pin contact-receiving space therebetween.

In preferred embodiments, the first beam is configured to lie substantially in a first horizontal plane and the second beam is configured to lie substantially in a vertical plane in spaced-apart relation to the first beam. The blade is configured to lie substantially in a second horizontal plane underlying the distal end of the first beam in spaced-apart relation to the first horizontal plane. Also, the blade is arranged to lie at about a right angle to the distal portion of the support arm.

Advantageously, the shape, length, and mass of the first and second beams are different to ensure that the chance of the normal frequency of each beam being the same is remote. These beam configurations reduce the likelihood that the socket contact will suffer electrical intermittency problems when subjected to shock or vibration.

A flat pattern is also disclosed for providing a plurality of electrical socket contacts. The flat pattern includes a carrier strip and a plurality of socket contacts connected to the strip. The carrier strip has a plurality of junction points uniformly spaced along an edge of the carrier strip so that each pair of adjacent junction points is separated by a predetermined dimension.

Each socket contact has a longitudinal axis and includes a body portion having a tail connected to the carrier strip at one of the junction points. Each junction point has a tail of one socket contact connected thereto.

First and second beams are coupled to the body portion to provide a pair of pin contact-engaging members. Each socket contact has a maximum transverse width dimension in its flat position greater than the predetermined dimension between each pair of adjacent junction points on the carrier strip. Nevertheless, each contact can be bent and manipulated from its stamped "flat pattern" shape to align the first beam in the first horizontal plane and the support arm of the second beam in a vertical plane as described above to define a pin contact-receiving space between the first beam and the blade of the second beam.

Essentially, the body portions of each pair of adjacent socket contacts are arranged in uniformly spaced-apart relation so that the center-to-center spacing of the socket contacts matches the center-to-center spacing of the contact-receiving openings in the electrical contact housing. Further, the first beam of each socket contact is arranged to lie in nested relation to the second beam of one of its adjacent socket contacts to conserve valuable sheet material during manufacture of the flat pattern.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 5 is a perspective view of a socket contact in accordance with a second embodiment of the present invention that is configured to be preloaded upon insertion into a socket housing;

FIG. 6 is a longitudinal sectional view of the socket contact of FIG. 5 mounted in a socket housing and preloaded by ramp means in the housing to receive a contact inserted into the socket housing;

FIG. 7 is a transverse sectional view taken along lines 7—7 of FIG. 6 showing alignment of the first and second contact mating surfaces in vertically spaced-apart relation and engagement of tabs provided on each of the mating surfaces on one portion of the ramp means appended to an inner wall in the socket housing to preload the two socket contact beams; and FIG. 8 is a plan view of a flat pattern for providing a plurality of socket contacts of the type illustrated in FIG. 5 showing nesting of the as yet unbent socket contacts to accommodate the preloading tabs appended to the first and second mating surfaces.

DETAILED DESCRIPTION OF THE DRAWINGS

Figure 1:
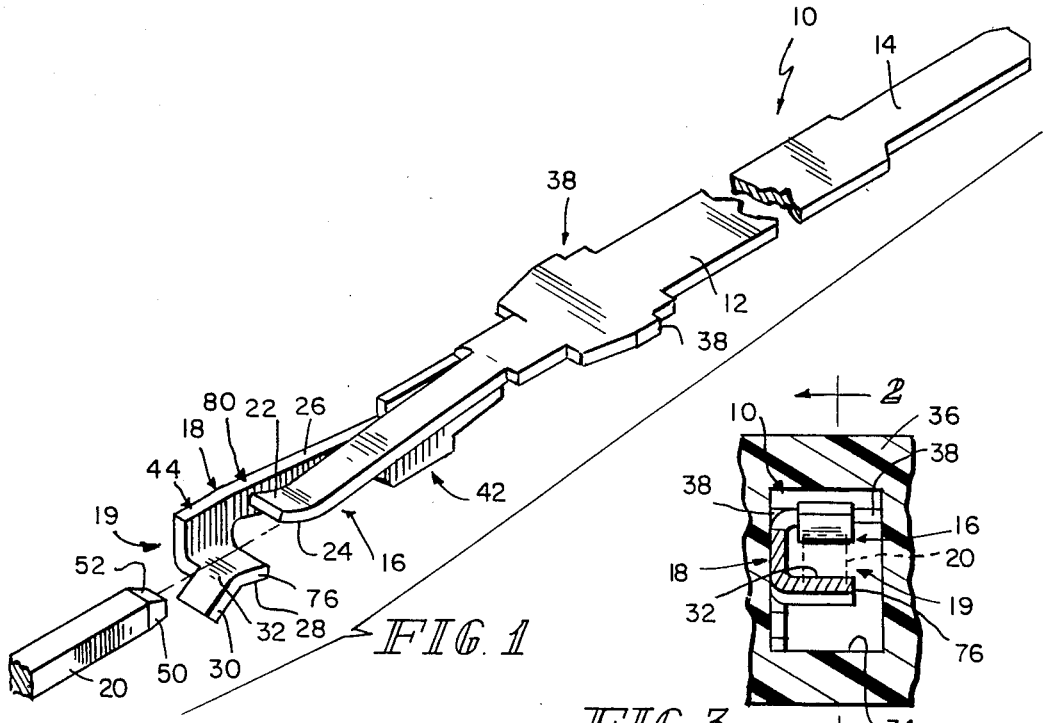
FIG. 1 is a perspective view of a socket contact in accordance with a first embodiment of the present invention.

Referring to FIG. 1, one preferred embodiment of a dual-beam socket contact 10 includes a body portion 12 having a solder tail 14 at one end and a pair of spring beams 16, 18 at the other end. The spring beams 16, 18 are configured in the novel manner shown in FIG. 1 to provide a receptacle 19 for receiving an electrical contact 2 therein.

Spring beam 16 is aligned in substantially coplanar relation to the horizontal plane of the body portion 12 and is therefore called the horizontal beam. It will be appreciated that horizontal beam 16 is pitched downward at a slight angle with respect to the body portion 12 to improve retention of the contact 20 in receptacle 19. Socket contact 10, and in particular beams 16, 18, are made of spring material to cause beams 16, 18 to grip contact 20 and establish an electrical connection therebetween. Horizontal beam 16 includes an upturned lip 22 at its distal end to provide a downwardly facing first contact mating surface 24.

As shown best in FIG. 1, spring beam 18 is aligned to lie in substantially orthogonal relation to the horizontal plane of the body portion 12 and is therefore called the vertical beam. Vertical beam 18 includes a support arm 26 appended to the body portion 12 and a blade 28 appended to the distal end of the support arm 26. The blade 28 is positioned to underlie the first contact mating surface 24 and includes a down-turned lip 30 providing an upwardly facing second contact mating surface 32.

The blade 28 is oriented to lie at about a right angle to the support arm 26 to present the second contact mating surface 32 in opposing relation to the first contact mating surface 24 to define the pin-contact-receiving space or receptacle 19 therebetween. Blade 28 includes a convex exterior surface providing the second contact mating surface 32 with a curved shape and the distal end of the horizontal beam 16 includes a convex exterior surface providing the first contact mating surface 24 with a curved shape. Although a square pin contact 20 is shown in the drawings, it will be appreciated that dual beams 16, 18 are configured to accept a variety of pin contact cross sections in receptacle 19.

Figure 3:
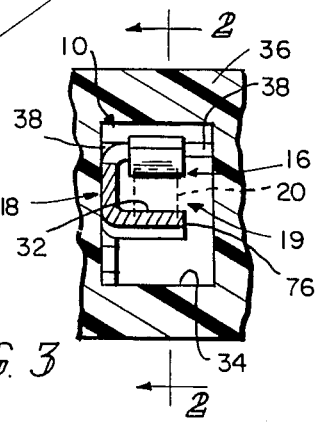
FIG. 3 is a transverse sectional view taken along lines 3—3 of FIG. 2 showing alignment of the first and second contact mating surfaces in vertically spaced-apart relation.
Figure 2:
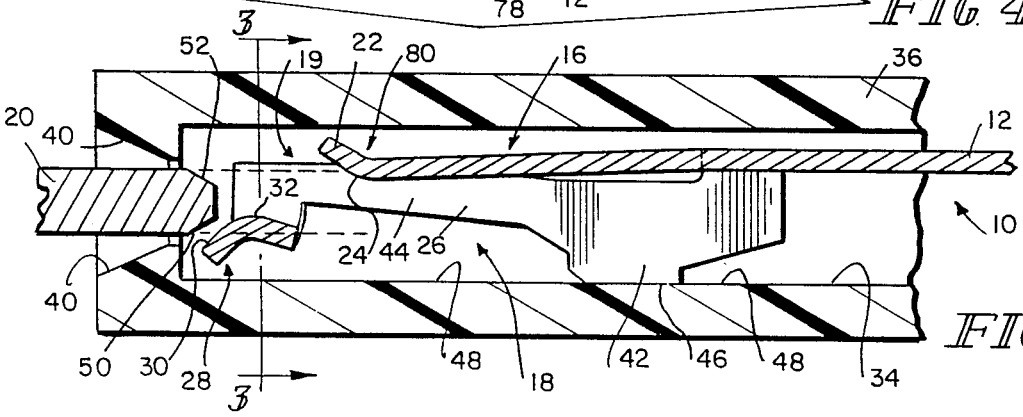
FIG. 2 is a longitudinal sectional view of the socket contact of FIG. 1 mounted in a socket housing and positioned to receive a contact inserted into the socket housing.

Each socket contact 10 is sized to fit inside a channel 34 formed in a socket housing 36 as shown, for example, in FIGS. 2 and 3. One or more retention barbs 38 are provided on body portion 12 to engage an inner wall in the socket housing 36 and position the socket contact 10 in the channel 34 so that the open mouth of receptacle 19 faces forwardly toward an aperture 40 formed in the housing 36 to permit introduction of electrical contact 20 into channel 34 to engage the first and second contact mating surfaces 24, 32. At the same time, solder tail 14 projects in a rearward direction away from aperture 40.

Figure 4:
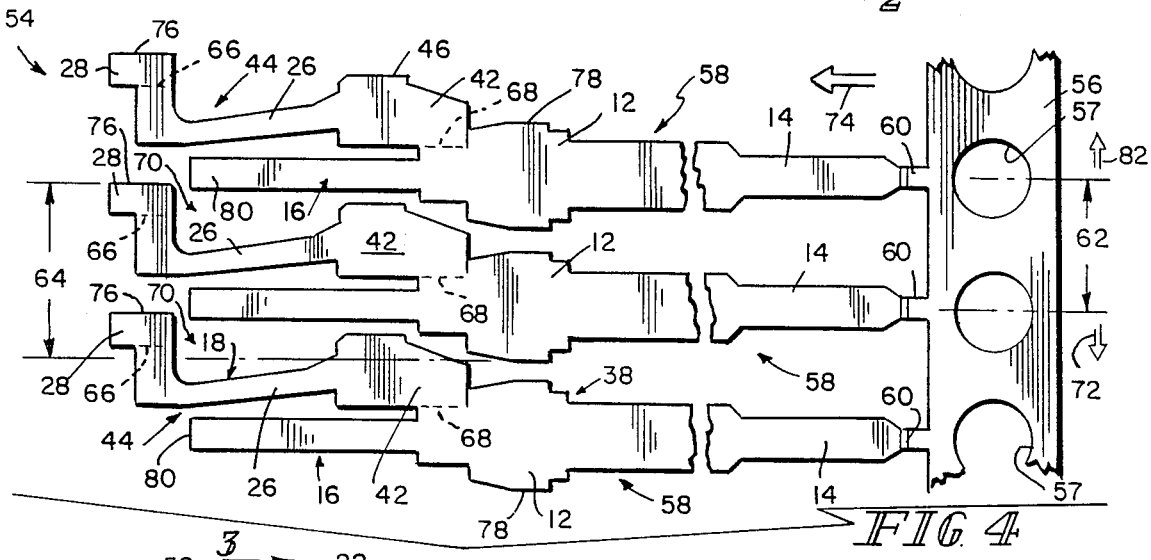
FIG. 4 is a plan view of a flat pattern for providing a plurality of socket contacts of the type illustrated in FIG. 1 showing one arrangement for nesting as yet unbent socket contacts in a flat pattern.

Each support arm 26 includes a side plate 42 and an L-shaped finger 44 interconnecting side plate 42 and blade 28 as shown best in FIGS. 2 and 4. Side plate 42 includes a support edge 46 engaging the bottom wall 48 of the housing channel 34 to support the vertical beam 18 in a stable position in channel 34 as shown in FIG. 2.

In operation, electrical contact 20 is inserted into channel 34 of socket housing 36 through aperture 40 to gain access to socket contact 10. As contact 20 is pushed into channel 34, a lower shoulder 50 on the tip of contact 20 engages the contact mating surface 32 on blade 28 and urges blade 28 downwardly toward bottom wall 48 of housing 36 against spring bias provided by the L-shaped finger 44. An upper shoulder 52 on the tip of contact 20 engages the contact mating surface 24 on the horizontal beam 16 in response to further movement of contact 20 into the open mouth of receptacle 19. Such engagement urges the upturned lip 22 upwardly against the spring bias provided by horizontal beam 16 to cause the contact 20 to be trapped between the two opposing contact mating surfaces 24, 32 with sufficient force to retain the contact 20 in the receptacle 19 and establish a good electrical connection between electrical contact 20 and socket contact 10.

As shown best in FIGS. 1 and 2, the mass geometry and angular alignment of beams 16, 18 differ so that the chance of the normal frequency of each beam 16, 18 being the same is remote to minimize the likelihood that socket contact 10 will "bounce" at the same rate and suffer electrical intermittency problems when subjected to shock or vibration. Further, the insertion force needed to insert electrical contact 20 into receptacle 19 is minimized while still maintaining the specified normal force needed to retain contact 20 in the receptacle because of the staggered or offset arrangement of the first and second contact mating surfaces 24, 32 in the housing channel 34. Moreover, the two opposing mating surfaces 24, 32 wipe the contact 20 during insertion to provide a clean surface for electrical contact while using as little material as possible.

A flat pattern 54 for producing a plurality of socket contacts 10 at high speeds using automated equipment is illustrated in FIG. 4. Flat pattern 54 includes a carrier strip 56 formed to include a series of holes 57 spaced to engage a sprocket wheel (not shown) or the like. Typically, a sprocket wheel rotates to advance the carrier strip 56 and the contact blanks appended to the strip 56 through one or more dies to form socket contact blanks 58 as shown in FIG. 4.

Each socket contact blank 58 is flat and connected to a junction point 60 on the carrier strip 56 at the outer tip of the solder tail 14. Each adjacent pair of junction points 60 are separated by a uniform dimension 62 chosen to cause the center-to-center spacing of the socket contact blanks 58 to match the center-to-center spacing of contact-receiving openings (not shown) formed in the socket housing 36. Such a match makes it possible to gang-insert the socket contact blanks 58 (once properly bent and formed to have the configuration of the socket contact 10 shown in FIG. 1) into the uniformly spaced-apart contact-receiving openings formed in the socket housing 36.

As shown in FIG. 4, the shapes of the vertical and horizontal beams 16, 18 are selected so that the horizontal beam 16 of one socket contact blank 58 is "nested" in a space provided in the L-shaped finger 44 of the vertical beam 18 of an adjacent socket contact blank 58. Such a nesting arrangement results in a socket contact blank having a maximum transverse width dimension (e.g., 64) that is greater than the predetermined dimension 62 between each pair of adjacent junction points 60 on the carrier strip 56.

The configuration of socket contact 10 illustrated in FIG. 1 is achieved by first bending blade 28 relative to L-shaped finger 44 about first bend line 66 to align blade 28 in substantially orthogonal relation to support arm 26. Next, support arm 26 is bent relative to body portion 12 about second bend line 68 to align side plate 42 in substantially orthogonal relation to body portion 12 so that beam 18 lies in a "vertical" plane and beam 16 lies in a "horizontal" plane. The blade 28 and the distal tip 22 of beam 16 are also bent to assume their convex shapes shown best in FIG. 2 to provide the somewhat curved first and second contact mating surfaces 24, 32.

Referring again to FIG. 4, it will be seen that each L-shaped finger 44 includes a longitudinally extending long leg and a transversely extending short leg which cooperate to define a partly enclosed region 70 therebetween. Also, the horizontal beam 16 of each socket contact blank 58 in the flat pattern 54 is arranged to lie in a nested position in the partly enclosed region 70 defined by the L-shaped finger 44 provided by the vertical beam 18 of one of the adjacent socket contact blanks 58.

The carrier strip 56 extends in a first direction 72 and each socket contact blank 58 extends in a second direction 74 away from the carrier strip 56. As shown in FIG. 4, each socket contact blank 58 in a preferred embodiment has a maximum transverse width 64 measured along a line extending in first direction 72 between a point on the end edge 76 of the second contact mating surface 32 and a point on the outer boundary edge 78 of the body portion 12.

In the illustrated embodiment, the maximum transverse width 64 of each socket contact blank 58 is about 0.153 inch and the dimension 62 between each pair of adjacent junction points 60 on carrier strip 56 is 0.100 inch. The fact that dimension 64 is greater than dimension 62 is due, in part, to the interlocking or nesting placement of adjacent socket contact blanks 58 in flat pattern 54.

The vertical beam blade 28 which provides the second contact mating surface 32 extends further in direction 74 away from carrier strip 56 than the horizontal beam tip 80 which provides the first contact mating surface 24. Further, blade 28 is offset from the horizontal beam 16 of its own socket contact blank 58 in a direction 82 to lie at least partly in front of the tip 80 of a neighboring horizontal beam 16 so that beam 16 is nested. Because of this nesting or interlocking of adjacent socket contact blanks 58 in flat pattern 54, only 0.100 inch width of expensive flat pattern material is required to produce each solder tail 14 and junction point 60 even though the two most opposite points on the socket contact blank 58 are 0.153 inch apart including allowance for punch width.

It will be appreciated that staggering the first and second contact mating surfaces 24, 36 of each beam 16, 18 in spaced-apart relation in direction 74 and nesting the first and second contact mating surfaces 24, 36 of adjacent socket contact blanks 58 produces a flat pattern 54 of the type shown in FIG. 4 wherein the socket contact blanks 58 can be stamped on 0.100 inch centers. The present invention overcomes the problem of manufacturing a socket contact blank 58 on 0.100 inch center to center spacing for use in a socket housing 36 having contact-receiving channels 34 also with 0.100 inch center to center spacing.

It will further be appreciated that socket contact 10 produced by bending the socket contact blank 58 stamped out in flat pattern 54 is able to interface with a square pin contact 20. Advantageously, valuable flat pattern material is conserved using the flat pattern 54 nested design because trim waste between contact beams 16, 18 is minimized due to the interlocking or nesting arrangement of beams 16, 18 of adjacent socket contact blanks 58. Not only is material waste reduced, but assembly time is minimized using the flat pattern 54 nested design because only one pass is needed to gang-insert all of the socket contacts 10 on a single carrier strip 56 into the corresponding channels 34 is a companion socket housing 36 simultaneously. Subsequently, the carrier strip 56 is sheared from the solder tails 14 to leave each socket contact 10 in a seeded position in its designated channel 34.

FIGS. 5–8 show another embodiment of the invention that is a modification of the embodiment shown in FIGS. 1–4. Those elements referenced by numerals identical to those in FIGS. 1–4 perform the same or similar function. The principal differences in the second embodiment as compared to the first embodiment include the formation of preloading tabs 84, 86 on the vertical and horizontal beams 16, 18 to interface with ramps or the like provided in a socket housing to preload the opposing first and second contact mating portions 24, 32 on the vertical and horizontal beams of a preloadable socket contact 100.

As shown best in FIGS. 5–7, extended tab 84 is provided at the distal end of horizontal beam 16 and another extended tab 86 is provided at the tip of blade 28. These tabs 84, 86 project away from beams 16, 18 in opposite directions in the flat pattern 88 configuration so that they will be aligned in spaced-apart parallel relation on the same side of socket contact 100 as shown in FIG. 5. This side-by-side alignment permits the pair of tabs 84, 86 to ride up a ramp 90 in socket housing 92 for the purpose of preloading the contact beams 16, 18.

As shown best in FIGS. 6 and 7, ramp 90 is formed to project from an inner wall 93 in housing 92 into channel 34 to provide a top cam ramp 94 for camming tab 84 and first contact mating surface 24 to its preloaded position and a bottom cam ramp 95 for camming tab 86 and second contact mating surface 32 to its preloaded position. It will be appreciated that the maximum transverse width dimension 96 of each socket contact blank in flat pattern 88 is wider than the width dimension 64 associated with flat pattern 54 because of the extension of tabs 84, 86. These tabs 84, 86 make the interlocking or nesting arrangement of the socket contact blanks in flat pattern 88 more pronounced.

Although the invention has been described in detail with reference to certain preferred embodiments, variations and modifications exist within the scope and spirit of the invention as described and defined in the following claims.

What is claimed is:

1. An electrical socket contact for conductively engaging a pin contact, the socket contact comprising a body portion having a tail for connection to an electrical circuit, a firstbeam having a proximal end cantileverd to the body portion and a distal end spaced a distance from the cantilevered proximal end and configured to provide a first contact mating surface, and a second beam arranged to lie alongside the first beam, the second beam including a blade having a second contact mating surface and a support arm having a proximal portion cantilevered to the body portion and a distal portion spaced at least the same distance from the body portion than the distal end is spaced from the body portion, the blade being coupled to the support arm at one side of the distal portion to lie at an angle to the distal portion so as to support the second contact mating surface in opposing relation to the first contact mating surface to define a pin contact-receiving space therebetween.

2. The socket contact of claim 1, wherein the blade is arranged to lie at about a right angle to the distal portion of the support arm.

3. The socket contact of claim 1, wherein the first beam is configured to lie substantially in a first horizontal plane, the second beam is configured to lie substantially in a vertical plane in spaced-apart relation to the first beam, and the blade is configured to lie substantially in a second horizontal plane underlying the distal end of the first beam in spaced-apart relation to the first horizontal plane.

4. The socket contact of claim 1, wherein the first beam has a first mass and the second beam and blade have a second mass different than the first mass so that the normal frequency of the first beam is different from the normal frequency of the second beam and blade.

5. The socket contact of claim 1, wherein the first beam includes a horizontally extending flat member and the support arm is arranged to lie substantially in a vertical plane in orthogonal relation to the horizontally extending flat member.

6. The socket contact of claim 5, wherein the proximal portion of the support arm is coupled to one side of the body portion to lie at an angle to the body portion so as to orient the support arm to lie in said vertical plane.

7. The socket contact of claim 5, wherein the body portion and the horizontally extending flat member of the first beam lie in substantially coplanar relation in a horizontal plane and the proximal portion of the support arm is coupled to one side of the body portion and configured to orient the support arm in said vertical plane so that it lies in orthogonal relation to the body portion.

8. The socket contact of claim 1, wherein the first contact mating surface on the distal end of the first beam intersects a first horizontal plane, the second contact mating surface of the blade intersects a second horizontal plane and at least the distal portion of the support arm is configured to lie substantially in a vertical plane in orthogonal relation to the horizontal planes of the first and second mating surfaces.

9. The socket contact of claim 8, wherein the tail lies substantially in the first horizontal plane, the blade includes a convex exterior surface providing the second contact mating surface with a curved shape and facing upwardly toward the first horizontal plane, the distal end of the first beam includes a convex exterior surface providing the first contact mating surface with a curved shape and facing downwardly toward the second horizontal plane, and the first and second contact mating surfaces are arranged in vertically spaced-apart relation.

10. The socket contact of claim 1, wherein the first beam further includes a first preloading barb appended to the distal end of the first beam and oriented to extend in a direction away from the support arm of the second beam and a second preloading barb appended to the blade and oriented to extend in a direction away from the support arm of the second beam.

11. The socket contact of claim 10, wherein the first and second preloading barbs are arranged in horizontally spaced-apart relation along the length of the socket contact and in vertically spaced-apart relation transverse to the length of the socket contact.

12. An electrical socket contact for conductively engaging a pin contact, the socket contact comprising a body portion having a tail for connection to an electrical circuit, a first spring member having a fixed length, proximal end cantilevered to the body portion and a distal end configured to provide a first contact mating surface, the first spring member being oriented to lie substantially in a first plane, a second spring member having a length at least equal to the fixed length of the first spring member, a proximal end cantilevered to the body portion and a distal end, the second spring member being oriented to lie substantially in a second plane orthogonal to the first plane, and a blade configured to provide a second contact mating surface, the blade being coupled to the second spring member and oriented to position the second contact mating surface in spaced-apart opposing relation to the first contact mating surface to define a pin contact-receiving space therebetween.

13. The socket contact of claim 12, wherein the first spring member includes a first preloading tab appended to the distal end of the first spring member and the second spring member includes a second preloading tab appended to the distal end of the second spring member.

14. The socket contact of claim 12, wherein the second spring member includes an end edge at its free end and at least one side edge extending between the end edge and the proximal portion, the blade is coupled to the at least one side edge of the second spring member to lie at an angle to the second spring member so as to support the second contact mating surface in opposing relation to the first contact mating surface.

15. The socket contact of claim 14, wherein the blade is arranged to lie at about a right angle to the second spring member.

16. The socket contact of claim 14, wherein the proximal portion of the second spring member is coupled to one side of the body portion to lie at an angle to the body portion so as to orient the second spring member to lie in said second plane and to orient the blade to lie substantially in a third plane aligned in spaced-apart parallel relation to said first plane.

17. The socket of claim 16, wherein the blade includes a convex exterior surface providing the second contact mating surface with a curved shape and facing upwardly toward the first plane, and the distal end of the first spring member includes a convex exterior surface providing the first contact mating surface with a curved shape and facing downwardly toward the third plane, and the first and second contact mating surfaces are arranged in vertically spaced-apart relation.

18. An electrical socket contact for conductively engaging a pin contact, the socket contact comprising, a body portion having a tail for connection to an electrical circuit, a first spring member of fixed length coupled to the body portion to have a substantially horizontal orientation, the first spring member including a first contact mating surface, a second spring member having a length at least equal to the fixed length of the first spring member and coupled at a proximal end to the body portion to have a substantially vertical orientation, and a blade including a second contact mating surface, the blade being coupled to a distal end of the second spring member to have a substantially horizontal orientation and to position the second contact mating surface in opposing relation to the first contact mating surface to define a pin contact-receiving space therebetween.

19. The socket contact of claim 18, wherein the first spring member further includes a first preloading tab appended to the first contact mating surface and a second preloading tab appended to the second contact mating surface.

20. The socket contact of claim 19, wherein the first spring member further includes a first preloading tab appended to the first contact mating surface and a second preloading tab appended to the second contact mating surface.

21. A flat pattern for a plurality of electrical socket contacts, the flat pattern comprising a carrier strip having a plurality of junction points uniformly spaced along an edge of the carrier strip so that each pair of adjacent junction points is separated by a predetermined dimension, and a plurality of socket contacts, each socket contact having a longitudinal axis and including a body portion having a tail connected to the carrier strip at one of the junction points, each junction point having a tail of one socket contact connected thereto, and first and second beams coupled to the body portion to provide a pair of pin contact-engaging members, each socket contact having an outer edge portion that extends in a transverse width dimension to be approximately in line with an edge surface of the body portion of an adjoining socket contact.

22. The flat pattern of claim 21, wherein the transverse width dimension of each socket contact is about one and one-half times greater than said predetermined dimension.

23. The flat pattern of claim 21, wherein the body portions of each pair of adjacent socket contacts are arranged in uniformly spaced-apart relation, and the first beam of each socket contact is arranged to lie in nested relation to the second beam of one of its adjacent socket contacts.

24. The flat pattern of claim 21, wherein each second beam is an L-shaped member having a long leg lying alongside the first beam and a short leg extending at an angle to the long leg and cooperating with the long leg to define a partly enclosed region, and the first beam of each socket contact is arranged to lie in a nested position in the partly enclosed region defined by the L-shaped member provided by the second beam of one of its adjacent socket contacts.

25. The flat pattern of claim 21, wherein the second beam is an L-shaped member having a long leg lying alongside the first beam and a short leg extending at an angle to the long leg, the long leg having a first end connected to the body portion and a second end connected to the short leg, the short leg cooperating with the body portion to define a partly enclosed region, and at least a portion of the body portion of each socket contact is arranged to lie in a nested position in the partly enclosed region defined by the short leg and the body portion of one of its adjacent contacts.

26. The flat pattern of claim 25, wherein each body portion includes at least one retention barb arranged to provide said portion of the body portion lying in said partly enclosed region.

27. A flat pattern for a plurality of electrical socket contacts, the flat pattern comprising a carrier strip extending in a first direction and having a plurality of junction points uniformly spaced along an edge of the carrier strip so that each pair of adjacent junction points is separated by a predetermined dimension, and a plurality of socket contacts, each socket contact extending in a second direction perpendicular to the first direction and including a body portion having an outer boundary edge and a tail connected to the carrier strip at one of the junction points, each junction point having a tail of one socket contact connected thereto, a first beam having a proximal end coupled to the body portion and a distal end providing a first contact mating surface, a second beam having a proximal end coupled to the body portion and a distal end, a blade having a proximal end coupled to the distal end of the second beam and a distal end providing a second contact mating surface having an end edge, each socket contact having its end edge substantial in alignment with a longitudinal edge surface of the body portion of the second contact mating surface 28. The flat pattern of claim 27, wherein a dimension of a maximum width of each socket contact is about one and one-half times greater than said predetermined dimension between each pair of adjacent junction points on the carrier strip.

29. A flat pattern for a plurality of electrical socket contacts, the flat pattern comprising a carrier strip extending in a flat direction and having a plurality of junction points uniformly spaced along an edge of the carrier strip so that each pair of adjacent junction points is separated by a predetermined dimension, and a plurality of socket contacts, each socket contact extending in a second direction perpendicular to the first direction and including a body portion having an outer boundary edge and a tail connected to the carrier strip at one of the junction points, each junction point having a tail of one socket contact connected thereto, a first beam having a proximal end coupled to the body portion and a distal end providing a first contact mating surface a first preloading tab appended to the first contact mating surface, a second beam having a proximal end coupled to the body portion and a distal end, and a blade having a proximal end coupled to the distal end of the second beam and a distal end providing a second contact mating surface a second preloading tab appended to the second contact mating surface, the second preloading tab having an end edge that lies approximately in alignment with an outer edge surface of the first contact mating surface of an adjoining socket contact.

30. The flat pattern of claim 29, wherein the first preloading tab extends in the first direction to project away from the second beam and the second preloading tab extends in a direction opposite to the first direction to project away from the first beam.

31. An electrical socket contact for conductively engaging a pin contact, the socket contact comprising a body portion, a first beam having an end portion cantileveredly connected to said body portion and a second end portion providing a first contact portion, a second beam having an end portion cantileveredly connected to said body portion along a line at right angles to and spaced from the cantilever connection of said first beam, said second beam having a contact portion at an end opposite its cantilever connection to the body portion, wherein the spacing of the two cantilever connections causes the first and second beam to flex at right angles to the line connection of the second cantilever connection upon an initial insertion of a pin contact, and wherein upon further insertion of the pin contact the first contact flexes at its cantilever connection to the body portion.

32. An electrical contact according to claim 31, wherein the second contact flexes in the same direction as the initial flexing of the first contact.

33. An electrical contact according to claim 31, wherein the initial insertion of the pin contact causes the first contact to flex in an opposite direction from its second flexing.

34. An electrical contact according to claim 33, wherein the second contact flexes in the same direction as the initial flexing of the first contact.

* * * * *

UNITED STATES PATENT AND TRADEMARK OFFICE

CERTIFICATE OF CORRECTION

PATENT NO. : 4,973,273

DATED : November 27, 1990

INVENTOR(S) : James F. DePriest

It is certified that error appears in the above-identified patent and that said Letters Patent is hereby corrected as shown below:

In column 5, line 2, please replace "2" with --20--.

In column 12, line 25, please replace "flat" with --first--.

Signed and Sealed this

Twenty-first Day of April, 1992

*Attest:*

HARRY F. MANBECK, JR.

*Attesting Officer*

*Commissioner of Patents and Trademarks*